United States Patent [19]

Taylor

[11] 4,015,774

[45] Apr. 5, 1977

[54] DUAL CENTRIFUGE AND SAMPLE CONTAINER

[75] Inventor: Daniel G. Taylor, Minneapolis, Minn.

[73] Assignee: Minneapolis War Memorial Blood Bank, Minneapolis, Minn.

[22] Filed: June 7, 1976

[21] Appl. No.: 693,649

[52] U.S. Cl. ..... 233/26

[51] Int. Cl.[2] ..... B04B 5/04; B04B 11/06

[58] Field of Search ..... 233/19 R, 21, 22, 23 R, 233/24, 25, 26, 1 R, 27

[56] References Cited

UNITED STATES PATENTS

| | | | |
|---|---|---|---|
| 1,566,770 | 12/1925 | Packer | 233/25 X R |
| 2,822,127 | 2/1958 | Sinn | 233/25 X R |
| 3,133,881 | 5/1964 | Childs | 233/26 X R |
| 3,439,871 | 4/1969 | Unger | 233/26 X R |
| 3,880,592 | 4/1975 | Kelley et al. | 233/26 X R |

*Primary Examiner*—George H. Krizmanich
*Attorney, Agent, or Firm*—Browdy and Neimark

[57] ABSTRACT

A centrifuge apparatus for separating whole blood into its serum and cell components. The device consists of a small centrifuge cup having a movable bottom wall formed by an upwardly movable piston. The cup is surrounded by a three-tiered ring-shaped container with the two upper tiers each containing a plurality of pockets. The centrifuge cup is spun at a high speed and the whole blood sample in the cup is separated, with excess sample expelled into the lowest tier. The multi-pocketed container is also spun as a centrifuge coaxially with the cup but at a lower speed. The bottom wall piston of the cup and the container are movable vertically relative to the cup by respective cams operated by a common timer-controlled motor. The container moves downwardy and the piston moves upwardly so that when the first multi-pocketed tier is adjacent the top of the cup, the piston is in a position to force the serum component out of the cup and into the tier pockets at this level; when the container moves further downwardly to bring the second multi-pocketed tier adjacent the top of the cup, the piston is in a position to expel the cell components into the pockets at this level.

20 Claims, 6 Drawing Figures

DUAL CENTRIFUGE AND SAMPLE CONTAINER

FIELD OF THE INVENTION

This invention relates to apparatus for the centrifugal separation of liquid, and more particularly to an apparatus for centrifugally separating the serum from the cell components of whole blood for subsequent biochemical analysis.

BACKGROUND OF THE INVENTION

In the normal procedure of preparing whole blood samples for typing and other tests, the samples are first centrifuged to separate the blood into its serum and cell components. The serum and cell components are then manually subdivided into smaller portions and placed in a number of test containers, using an eyedropper for distributing the serum and cells into the test containers. Reagents are then added to each container, and time is allowed for reactions to occur.

The reagents are either 1) serum containing antibodies of known type, or 2) cells of known blood types. The reaction looked for is the agglutination or clumping together of single cells into clumps of cells, where the cells can be either those in the reagent or those in the blood sample.

SUMMARY OF THE INVENTION

A main object of the invention is to provide a novel and improved apparatus for automatically centrifugally separating the serum from the cell components of whole blood samples and for facilitating their biochemical analysis, the apparatus being relatively simple in construction, compact in size, and requiring only a small volume of initial blood sample.

A further object of the invention is to provide an improved double centrifuge apparatus for automatically centrifugally separating the serum from the cell components of a whole blood sample and for collecting same in discrete amounts for biochemical analysis, the apparatus automatically collecting the separated material in receptacles for independent testing or analysis, requiring only a small quantity of blood sample, for example, of the order of 1 ml, operating to automatically control the sample size, acting to automatically separate the sample into cells and serum, acting to automatically subdivide the serum and cells into separate multiple pockets for individual testing by multiple reagents in parallel, acting to inherently accurately control the size of the serum and cell samples in the respective pockets, and enabling the respective pockets to be easily indexed and identified.

The central feature of the apparatus of the apparatus of the present invention is the use of a small centrifuge cup with a substantially cylindrical bore, an inwardly projecting lip or rim at its top, and a movable bottom surface formed by an upwardly movable piston.

The operation of the apparatus starts when a sample of whole blood is poured into the central centrifuge cup. The centrifuge cup is then spun at high speed, and the liquid in the cup forms an annular ring at the outer wall, extending inwardly toward the center as far as the bore of the cup's upper lip. Any excess liquid that cannot be contained in this ring is thrown out immediately. Since the centrifuge cup can be deliberately overfilled at the beginning, this procedure gives a precisely controlled sample volume for testing.

Surrounding the centrifuge cup is a ring-shaped molded receptacle with many pockets. In a typical embodiment, this receptacle has three tiers or levels, and is used as a sample container. Each level has a vertical back wall, with a row of pockets around the base of the wall, at the two upper levels, to hold the divided-up sample portions and reagents. The top level is for cells only, and in the above-mentioned typical embodiment, contains 8 pockets. The middle level is for serum only and contains 8 pockets. The lower level collects the initial overfill from the centrifuge cup, and has only one pocket. The number of pockets on each level is not restricted to one or eight, but can be made any convenient number.

The multi-pocketed sample container is also spun as a centrifuge about the same axis and concentric with the central centrifuge cup, but at a lower speed.

The apparatus has provision for changing the relative height of the sample container with respect to the centrifuge cup (or vice versa) so that liquid can be thrown out of or dispensed from the spinning centrifuge cup to any one of the three levels in the sample container.

BRIEF DESCRIPTION OF THE DRAWINGS

For a better understanding of the invention, a typical embodiment thereof will now be described with reference to the attached drawings, it being understood that this embodiment is intended to be merely exemplary and in no way limitative.

DESCRIPTION OF A PREFERRED EMBODIMENT

Figure 1:
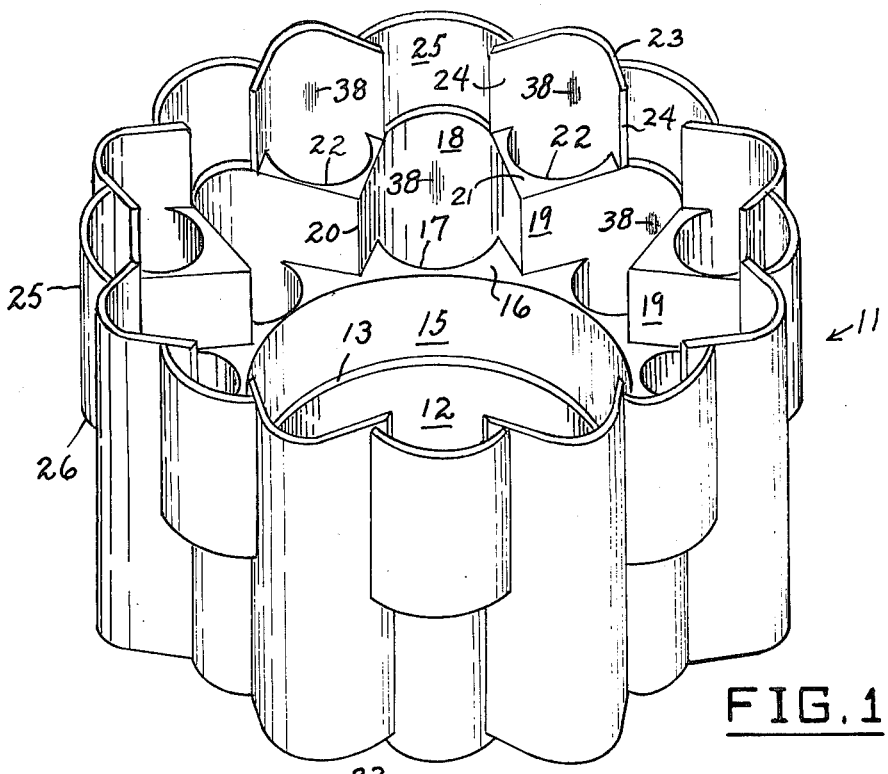
FIG. 1 is a perspective view of the main body portion of a sample container employed in a centrifuge apparatus according to the present invention.

Referring to the drawings, and more particularly to FIGS. 1 to 4, 11 designates a typical container for a blood sample to be centrifuged in accordance with the present invention. The container 11 comprises a central cylindrical sleeve member 12 having a top rim 13, defining the lowest level of centrifuge operation.

Sleeve member 12 forms the inner wall of an annular waste pocket 14 outwardly adjacent rim 13 and having an outer annular wall 15 which rises above the level of rim 13 to a horizontal surface 16 which defines the second, or serum-collecting level of centrifuge operation. Surface 16 leads to a plurality of spaced generally cylindrical serum-collecting pockets 17 formed integrally with the body of the molded container 11. In the typical container herein illustrated there are eight equally spaced serum-collecting pockets 17. The molded body is formed at the respective pockets 17 with vertical curved, inwardly facing, back wall upper extensions 18 merging with inwardly diverging vertical side wall portions 19, 19 which define serum-collecting channels leading to the respective pockets 17, the guide walls 19 of adjacent channels merging to define vertical corners 20. The back wall extensions 18 and side wall portions 19 rise to a horizontal surface 21 defining the third and uppermost level of centrifuge operation, for collecting the cell components of the blood sample.

Integrally formed at said upper level outwardly adjacent said corners are the vertical generally cylindrical cell-collecting pockets 22. The pockets 22 have curved inwardly facing back wall upper extensions 23 integrally formed with inwardly diverging vertical side wings 24, 24 defining collecting channels for centrifuged blood cell material, leading to the pockets 22.

The vertical side wings 24 terminate at the subjacent serum-collecting pocket guide walls 19. The rear surfaces of the adjacent cell-collecting channels are connected by the upstanding vertical curved inwardly facing liquid-collecting walls 25 of the outer liquid-collection receptacles 26 formed integrally with the molded container body.

Designated generally at 27 is a centrifuge cup assembly mounted coaxially in sleeve 12. Cup assembly 27 comprises a hollow vertical supporting shaft 28 having an integral bottom cup segment 29 at its top end. An annular top cup segment 30 is threadedly secured to bottom segment 29. Top cup segment 30 has an inwardly extending top lip or flange 31 having an upwardly flaring frusto-conical inner rim surface 32 to facilitate outward flow of centrifuged material from the annular cavity defined between the bottom surface of flange 31 and the top rim surface 72 of a piston 33 provided in the generally cylindrical interior of the cup assembly 27. Rim surface 72 is defined by a central sample-receiving recess 34 provided in the piston. Piston 33 is provided with an axial control rod 35 extending slidably through the central bore of hollow shaft 28.

Figure 2:
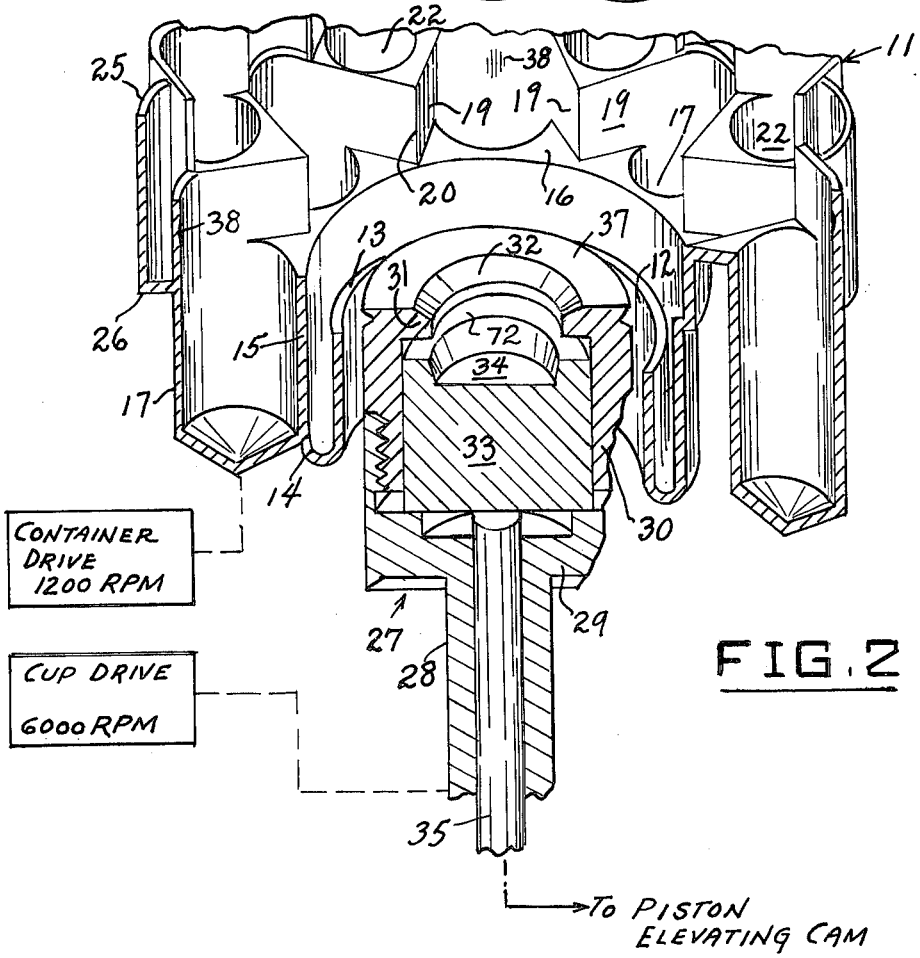
FIG. 2 is a fragmentary perspective view, partly in vertical cross-section showing the cup and container structure of the centrifuge apparatus in a starting condition, with the lower level of the container adjacent the top of the centrifuge cup.

It will be seen from FIG. 2 that in the starting position the top surface 37 of upper cup segment 30 is adjacent to or slightly above the level of the sleeve top rim 13. This represents the lowermost level of centrifuge operation relative to the container 11.

When the central centrifuge cup assembly, containing a blood sample, is initially spun, with the container 11 stationary it is at said lower level, shown in FIG. 2. The initial overfill is thrown out into the annular collection receptacle 14, and the centrifuge cup assembly is spun for a sufficient time (about 10 to 15 seconds) to separate the whole blood sample into its cell and serum components. The cells, being heavier, go to the outer periphery of the ring of liquid in the cup (between flange 31 and the rim 72), and the serum goes to the inner periphery. The whole blood of humans is normally 30% to 50% cells and 50% to 70% serum.

Figure 3:
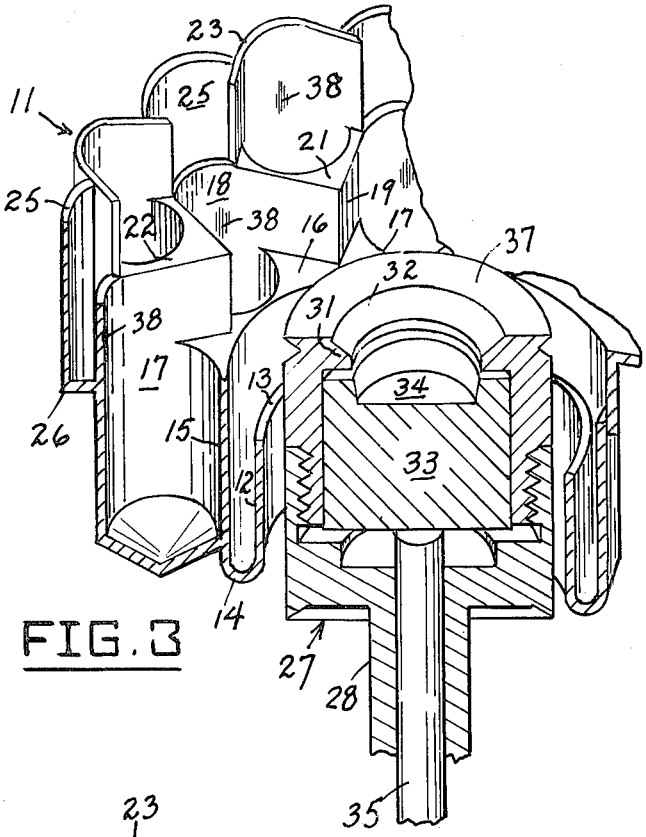
FIG. 3 is a fragmentary perspective view similar to FIG. 2, with the middle level of the container adjacent the top of the centrifuge cup.

The container height is then adjusted relative to the cup assembly so that the centrifuge cup assembly is at the middle level, defined by surface 16, and the piston 33 is moved up approximately 40% of its stroke, as shown in FIG. 3. This forces the serum on the inner surface of the ring of liquid to go up over the lip or flange 31, where, with the container 11 still stationary, it is thrown out onto the vertical boundary wall configuration of the middle level, namely, the configuration comprising wall elements 18, 19 bounding the surface level at 16. The piston stroke length is deliberately set less than the minimum serum percentage, so that only serum and no cells is dispensed at the middle level.

Figure 4:
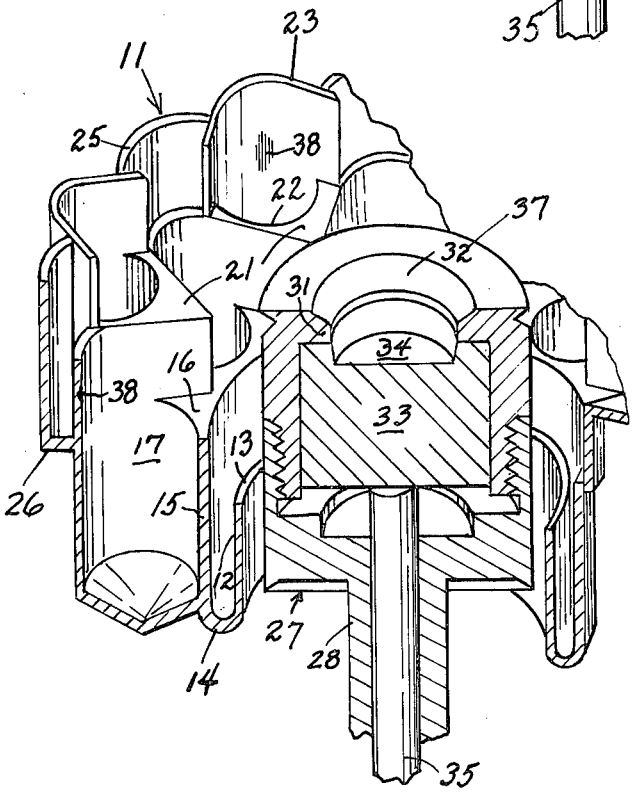
FIG. 4 is a fragmentary perspective view similar to FIG. 2, with the upper level of the container adjacent the top of the centrifuge cup.

The container height is then again adjusted relative to the cup assembly so that the centrifuge cup assembly is at the top level, defined by surface 21, and the piston 33 is moved up to the 100% stroke position abutting the underside of flange 31, as shown in FIG. 4, with the container 11 still stationary, forcing all of the remaining liquid out of the cup assembly and throwing it onto the vertical boundary wall configuration of the top level, namely, the configuration comprising the wall elements 23, 24, 25 bounding the surface level at 21. All of the cells are thus dispensed on the top level, along with some serum, which does not matter for the purpose at hand.

If cells only are wanted on the upper level, the container height can be adjusted so that relatively the cup is returned to the lower level after dispensing serum at the middle level. The piston 33 is then advanced upwardly from its 40% stroke position to its 80% stroke position, throwing the variable composition portion of the sample out into the lower level receptacle 14, and leaving only the last 20% (cells only) in the centrifuge cup assembly. The container height is then adjusted so that relatively the cup assembly is at the third level, and the piston 33 is then advanced to its 100% stroke position of FIG. 4. The remaining 20% in the cup assembly (cells only) is forced out and thrown onto the vertical boundary wall configuration of the top level.

Due to the small volume of the initial blood sample, there is not enough liquid on the vertical wall elements of the middle and top levels of the sample container to run down into the pockets below. There is, at this stage, just a narrow strip of wetness adhering to the vertical wall elements. Therefore, the wall elements over the pockets are not smoothly cylindrical but preferably are sculpted radially outwardly at 38 over each pocket to define collection recesses over each pocket. The sample container is now lowered by a cam 48 and is thereby spun, causing the narrow strip of wetness on each sculpted wall to coalesce into a single drop at the largest wall radius region over each pocket, namely, at 38. Each drop then eventually runs down the associated collection wall element to the bottom of the subjacent pocket. Although not essential to the present invention, it is desirable that the collected sample volumes on the middle and top levels be substantially the same. One third of the 60% sample volume dispensed at the top level should be eliminated to provide sample volume equal to the 40% sample volume dispensed at the middle level. To this end, the vertical wall surface configuration at the upper level is interrupted in such a way that only two-thirds of the vertical wall configuration will collect liquid for each pocket, and the remaining one-third collects liquid into the small additional waste pockets 26.

Each pocket of the sample container 11 thus finally contains a small portion of the original blood sample, with serum portions on the middle level and cell portions on the top level. Different reagents may be put in each pocket. The sample container 11 may be provided with an angle index to indicate which reagent is contained in each pocket.

Thus, to summarize:

1. Only a 1 ml blood sample is needed to perform all blood tests.
2. The sample size is automatically controlled to a fixed volume.
3. The original blood sample is automatically separated into cells and serum.
4. The serum and cells of the original whole blood sample are automatically subdivided into separate multiple pockets for individual testing by multiple reagents in parallel.
5. The serum samples in each pocket on the middle level are inherently of equal size.
6. The cell samples in each pocket on the upper level are inherently of equal size.
7. The sample volumes on the middle and upper levels can be made equal if desired.
8. The sample container may have an angle index to indicate which reagent is contained in each pocket.

Figure 5:
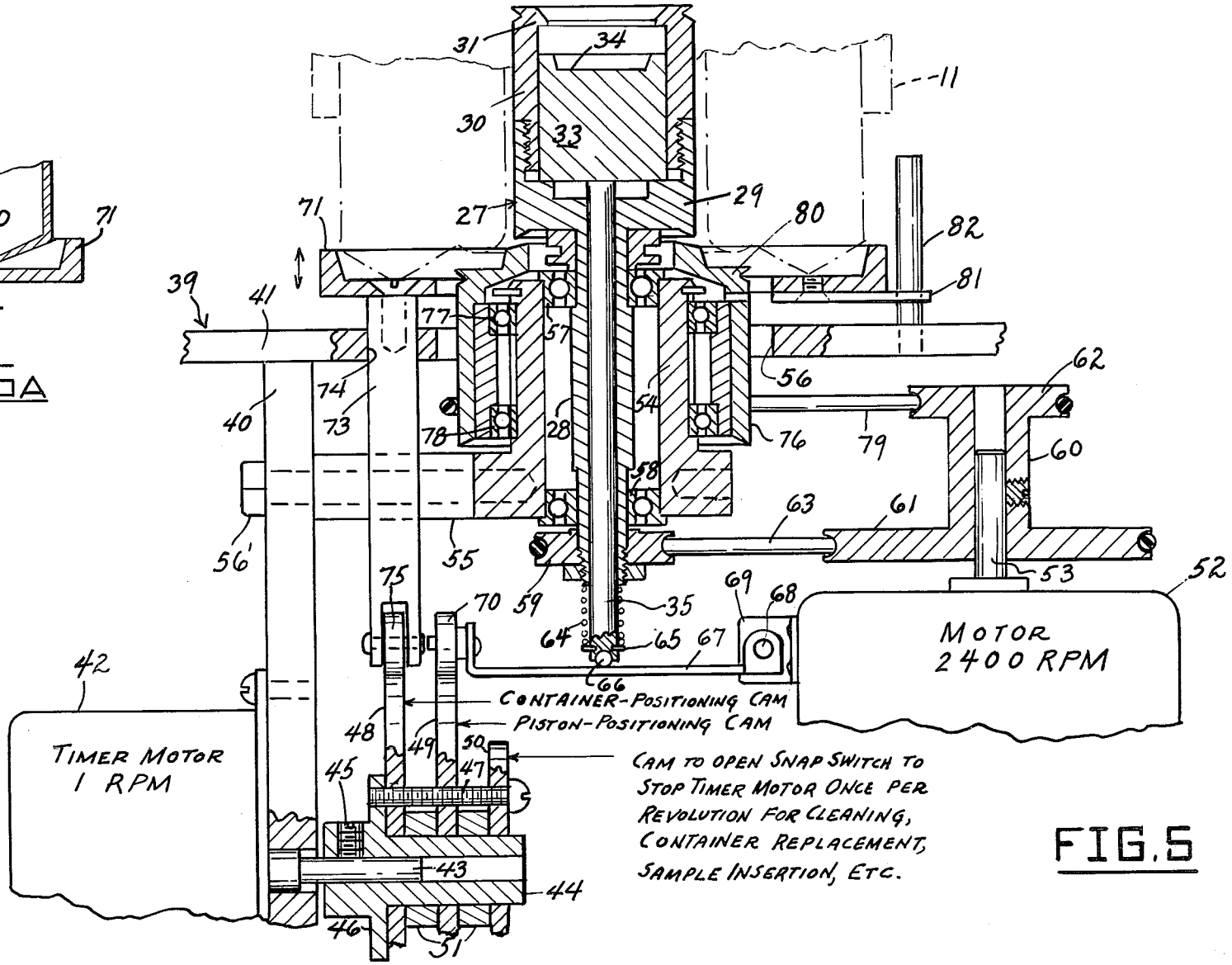
FIG. 5 is a fragmentary, partly diagrammatic, vertical cross-sectional view of a centrifuge apparatus according to the present invention.

Referring to FIG. 5, a typical centrifuge apparatus according to the present invention may comprise a stationary supporting frame structure, designated generally at 39, including a vertical plate member 40 and a horizontal plate member 41 rigidly secured to the top end of member 40. A 1 RPM timer motor 42 is mounted on plate member 40 with its shaft 43 extending horizontally through said plate member. A cam sleeve 44 receives and is secured on shaft 43, as by a set screw 45. Sleeve 44 has a flange 46. Mounted on sleeve 44 and rigidly secured to flange 46, as by one or more fastening bolts 47, are the respective cams 48, 49 and 50, spaced apart by spacer rings 51.

A 2400 RPM drive motor 52 is rigidly mounted in the frame structure 39 by suitable means, not shown, with its shaft 53 extending vertically.

A vertical bearing sleeve 54 is rigidly secured to plate member 40 by a bolt 56' which extends through a spacer sleeve 55 and is threadedly engaged in the lower end portion of said bearing sleeve 54. Vertical bearing sleeve 54 is thus supported substantially centrally in a circular aperture 56 provided in horizontal plate member 41. Hollow shaft 28 is suitably journalled in sleeve 54, for example, by means of top and bottom ball bearing assemblies 57, 58. A relatively small pulley 59 is secured on the lower end portion of shaft 28. Secured on motor shaft 53 is a double pulley assembly 60 having the relatively large lower drive pulley element 61 and the relatively small upper drive pulley element 62. A drive belt 63 drivingly couples motor pulley 61 to cup pulley 59, providing a cup driving speed of 6000 RPM.

Piston control rod 35 is biased downwardly by a coiled spring 64 surrounding the lower end portion of the rod 35 and bearing between the bottom rim of shaft 28 and a washer 65 carried on the bottom end of the rod. A follower ball 66 is provided in the bottom end of rod 35 and bears on a lever 67 pivoted at 68 to a stationary bracket 69. The free end of lever 67 is provided with a follower roller 70 which engages on the periphery of cam 49, to thereby control the vertical position of piston 33.

A generally annular container-supporting tray member 71 is provided substantially concentrically with aperture 56 and has a depending vertical supporting post member 73 which extends slidably through a conformably-shaped aperture 74 provided in plate member 41 over cam 48, the post member 73 being provided at its bottom end with a follower roller 75 which engages on the periphery of said cam 48, to thereby control the vertical positioning of a container 11 received in said tray member 71.

Figure 5A:
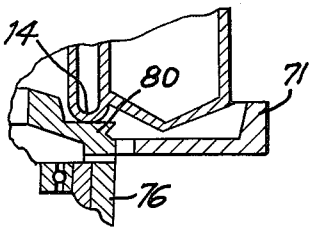
FIG. 5A is a fragmentary vertical cross-sectional view showing the container drivingly engaged with the driving shoulder of the container driving sleeve member in the lowermost position of the container, wherein liquid on the sculpted walls of the container is to be coalesced into drops.

A container-drive sleeve member 76 surrounds and is suitably journalled to bearing sleeve 54, for example, by top and bottom ball bearing assemblies 77, 78. Sleeve member 76 is drivingly coupled to motor pulley 62 by a drive belt 79, providing a container drive speed of 1200 RPM. Sleeve member 76 has an annular suitably shaped top container-coupling shoulder 80 drivingly engageable by the bottom of waste pocket 14 when the container 11 has been lowered by cam 48 to its lowermost position after the stage of FIG. 4, as shown in FIG. 5A, and wherein member 71 is lowered below a position of supporting engagement with the container, namely, at the stage above-described where it is desired to coalesce the liquid on the sculpted walls into drops in the recesses 38, as above described.

Tray member 71 is provided with an outwardly extending stabilizing bar element 81 which has an aperture slidably receiving an upstanding vertical guide post member 82 rigidly secured on plate member 41 opposite the location of guide aperture 74.

The cam 50 is employed in a conventional manner to open a snap switch, not shown, connected in circuit with the timer motor 42, at the end of a cycle of operation of the timer motor 42, to permit cleaning of the tray member 71 or other centrifuge parts, replacement of a container 11, and insertion of a blood sample. The snap switch may be manually closed to start a new cycle.

Summarizing, with the parts in their starting positions, shown in FIG. 2, a sample of whole blood is first poured into the central cup recess 34. The motors 52 and 42 are then energized, causing the centrifugal cup assembly 27 to be spun at high speed (of the order of 6000 RPM); the liquid forms an annular ring, as above described, and excess liquid is thrown out immediately into the pocket 14. After 10 to 15 seconds, sufficient to separate the whole blood sample into its cell and serum components, cams 48 and 49 adjust the container 11 and the cup element 33 to the relative positions of FIG. 3, forcing the serum on the inner surface of the ring of liquid to go up over the lip 31 and to be thrown out on surface level 16 and to enter the pockets 17. Following this stage, the cams 48 and 49 adjust the container 11 and cup element 33 to the relative positions of FIG. 4 (the container is not rotating at any of these three stages of relative adjustment). In the position of FIG. 4 the cup assembly 27 is at its top level relative to container 11 and cup element 33 is at its 100% stroke position, forcing all of the cells and/or remaining liquid out of the cup assembly and into the pockets 22 bounding surface level 21, as above described.

To collect the liquid on the vertical wall elements into the collection recesses 38, the cam 48 then lowers the tray member 71 to its lowermost position, shown in FIG. 5A, wherein the bottom of the annular compartment 14 drivingly engages with the rotating annular shoulder 80. This spins the sample container 11 at a speed of the order of 1200 RPM, causing the narrow strip of wetness on each sculpted wall to coalesce into a single drop into each recess 38 over a pocket, whereby the drops eventually run down to the associated subjacent pockets, as above described.

At the end of the above-described cycle of operation, cam 50 opens a snap switch to stop the timer motor 42, for preparing the apparatus for another similar cycle of operation. The main driving motor 52 may be switch-controlled in any suitable conventional manner.

While a specific embodiment of an improved centrifuge apparatus has been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. A centrifuge apparatus comprising a vertically-mounted centrifuge cup member, means for rotating said cup member, vertically movable bottom wall means in said cup member, means for at times moving said bottom wall means upwardly to force rotating liquid material out of said cup member, a container member surrounding said cup member, said container member having a plurality of levels containing collecting pockets, and means for positioning said container member and cup member at different relative heights such that material forced out of the cup member can be received respectively at the different levels.

2. The centrifuge apparatus of claim 1, and wherein the lowermost level on the container member comprises an overfill waste-collecting pocket.

3. The centrifuge apparatus of claim 2, and wherein the container member comprises at least second and third additional levels, each having a plurality of spaced sample-collecting pockets.

4. The centrifuge apparatus of claim 3, and wherein the pocketed second and third levels have upstanding boundary outer wall configurations including inwardly concave portions leading to the respective sample-collecting pockets.

5. The centrifuge apparatus of claim 4, and wherein said inwardly concave portions are formed with localized recessed areas, and means to rotate said container member to induce centrifugal collection of liquid material in said locallized recessed areas.

6. The centrifuge apparatus of claim 4, and wherein the third level comprises spaced sample-collecting pockets and respective waste liquid collection pockets located between the spaced sample-collecting pockets, the third level upstanding boundary wall configuration including inwardly concave wall portions leading to said waste liquid collection pockets.

7. The centrifuge apparatus of claim 4, and wherein the sample-collecting pockets on said second and third levels are substantially equal in volume.

8. The centrifuge apparatus of claim 1, and wherein said cup member is provided with an inwardly projecting top rim flange and said bottom wall means comprises a vertically movable piston in said cup member, defining a variable annular space for centrifuged liquid between said piston and said top rim flange.

9. The centrifuge apparatus of claim 8, and wherein said container member is mounted to be movable vertically relative to the cup member, and means to move the container member vertically to register the pocketed levels with the top of the cup member and to move the piston upwardly to force predetermined amounts of material out of the cup member at the respective levels.

10. The centrifuge apparatus of claim 9, and wherein the means to move the container member vertically and to move the piston comprises respective cam and follower assemblies operatively coupled to the container member and piston, and means to simultaneously operate said cam and follower assemblies.

11. The centrifuge apparatus of claim 1, and wherein the means for positioning said container member and cup member at different relative heights comprises means for moving the container member downwardly relative to the cup member from a starting position wherein the top of the cup member is substantially in registry with the lowermost container pocketed level.

12. The centrifuge apparatus of claim 11, and wherein said lowermost container pocketed level comprises an annular overfill collection pocket surrounding the cup member and having a vertically rising outer boundary wall leading to the next collecting pocket level.

13. The centrifuge apparatus of claim 1, and means to independently rotate the container member around the cup member.

14. The centrifuge apparatus of claim 13, and wherein the pockets of at least one of said levels have outer upstanding inwardly concave wall portions leading downwardly to the pockets, said outer wall portions including locally recessed areas to induce centrifugal collection of liquid material in said locally recessed areas.

15. In a centrifuge apparatus, a generally annular container for receiving centrifuged material, said container having a plurality of different levels, and collecting pockets formed in the respective levels.

16. The centrifuge apparatus of claim 15, and wherein said levels are arranged in outwardly ascending order.

17. The centrifuge apparatus of claim 16, and wherein said container includes a lower level comprising an annular overfill waste-collecting pocket, and at least second and third additional levels, each having a plurality of spaced sample-collecting pockets.

18. The centrifuge apparatus of claim 17, and wherein the second and third levels have upstanding outer boundary wall configurations including inwardly concave portions communicating with the respective sample-collecting pockets.

19. The centrifuge apparatus of claim 18, and wherein the inwardly concave portions are formed with locally recessed areas.

20. The centrifuge apparatus of claim 18, and respective waste liquid collection pockets located between the sample-collecting pockets of the third level, and upstanding inwardly concave wall portions leading to said last-named waste liquid collection pockets.

* * * * *